US007292142B2

(12) United States Patent
Simon et al.

(10) Patent No.: US 7,292,142 B2
(45) Date of Patent: Nov. 6, 2007

(54) METHOD AND APPARATUS FOR INTERFACING SECURITY SYSTEMS BY PERIODIC CHECK IN WITH REMOTE FACILITY

(75) Inventors: Scott Simon, Melville, NY (US); Robert J. Orlando, Nesconset, NY (US); William R. Blum, Huntington Station, NY (US)

(73) Assignee: Honeywell International, Inc., Morristown, NJ (US)

( * ) Notice: Subject to any disclaimer, the term of this patent is extended or adjusted under 35 U.S.C. 154(b) by 182 days.

(21) Appl. No.: 10/969,099

(22) Filed: Oct. 20, 2004

(65) Prior Publication Data

US 2006/0092010 A1 May 4, 2006

(51) Int. Cl.
*G08B 1/08* (2006.01)

(52) U.S. Cl. ..... 340/539.17; 340/531; 340/511; 340/425.5; 455/404.1

(58) Field of Classification Search ..... 340/539.17, 340/517, 426.1, 521, 425.5, 5.1–5.2, 506, 340/511, 426.24, 426.25, 531, 541; 307/10.2; 455/404.1, 404.2

See application file for complete search history.

(56) References Cited

U.S. PATENT DOCUMENTS

| | | | | |
|---|---|---|---|---|
| 4,792,946 | A | 12/1988 | Mayo | |
| 5,486,812 | A * | 1/1996 | Todd | 340/539.14 |
| 6,078,649 | A * | 6/2000 | Small et al. | 379/39 |
| 6,822,946 | B1 * | 11/2004 | Wallace | 370/328 |
| 7,035,270 | B2 * | 4/2006 | Moore et al. | 370/401 |
| 7,046,985 | B2 * | 5/2006 | Seales et al. | 455/404.1 |

FOREIGN PATENT DOCUMENTS

| | | |
|---|---|---|
| DE | 19913573 A1 | 9/2000 |
| EP | 0 039 203 A2 | 11/1981 |
| WO | WO 02/095702 A1 | 11/2002 |

OTHER PUBLICATIONS

"Remote Control for Your Home's Heating/Cooling System", Honeywell: Comfort, Energy & Health Solutions, Jun. 2001, printed Apr. 8, 2004 from http://content.honeywell.com/yourhome/tan/tam.asp.

"Honeywell Home Controller Gateway™"; printed Apr. 8, 2004 from http://www.eadhome.nl/producten/domotica/honeywell_convenience/honeywell_home_controller_gatewa.html.

W7006A Home Controller Gateway User Guide, Jul. 2001, printed Apr. 8, 2004 from: http://content.honeywell.com/yourhome/ac_automated_controllcentralized_intro.htm.

* cited by examiner

*Primary Examiner*—Benjamin C. Lee
*Assistant Examiner*—Daniel Previl
(74) *Attorney, Agent, or Firm*—Scully, Scott, Murphy & Presser, P.C.

(57) ABSTRACT

Security systems, such as in a home or other building, periodically transmit status data to a remote facility so that the remote facility is continuously informed of the security systems' status. A user interface device at one security system, or a web browser at a personal computer, can obtain information regarding, or provide commands to, one or more other security systems at remote locations by communicating with the remote facility. The remote facility also reports specified events, such as alarms, that occur at a security system to one or more other security systems. Other information, such as video and audio data from a security system, can also be provided to the remote facility for sharing with other security systems. An intercom feature can also be established via the remote facility.

1 Claim, 6 Drawing Sheets

METHOD AND APPARATUS FOR INTERFACING SECURITY SYSTEMS BY PERIODIC CHECK IN WITH REMOTE FACILITY

BACKGROUND OF THE INVENTION

1. Field of Invention

The invention relates generally to security systems and, more particularly, to interfacing security systems so that they communicate with one another.

2. Description of Related Art

Security systems, such as for homes and businesses, have become commonplace as people seek to protect themselves and their property. Security systems typically employ sensors at entry points, such as windows and doors, along with interior sensors such as motion detectors and glass break detectors. The user arms and disarms the system typically by entering a password on a keypad. In addition to sounding a local alarm, the security system may include a telephone dialer for informing a remote monitoring station of an alarm condition. Moreover, it is becoming more common for users to have multiple security systems, such as at a home, business, vacation home and the like.

There is a need for a convenient way to interface or link different security systems so that a user can operate the control panel of one security system to obtain information regarding other security systems, and control the other security systems, without being present at the locations of the other security systems.

BRIEF SUMMARY OF THE INVENTION

The present invention describes a solution that allows security systems to interface with one another to obtain periodically updated information.

The invention enables a user to stand at the user interface, such as a keypad, of a security system and control the user interface, such as by selecting an icon, to view the information from the interface of another, remote security system as if the user was standing in front of the other interface. For example, if the user had two homes, the user could select an icon from the interface of the first home's security system to virtually jump to the interface of the second home's security system. Furthermore, the user can send a command via the first home's security system to the second home's security system. A remote facility acts as an intermediary by periodically receiving updates from the security systems so the information is readily available.

In one aspect of the invention, a security apparatus is provided that includes a user interface device in a first security system, where the first security system secures a first building location and the user interface device is capable of providing information regarding the first security system to a user. A receiver is provided for receiving, from a remote facility, periodically updated information regarding a second security system that secures a second building location different than the first building location. The periodically updated information is transmitted to the remote facility by the second security system according to an update interval of the second security system, and the user interface device is responsive to the receiver and the periodically updated information for providing information regarding the second security system to the user.

In another aspect of the invention, a remote facility which is remote from a first security system that secures a first building location, and a second security system that secures a second building location different than the first building location, includes a receiver for receiving periodically updated information from a first security system that secures a first building location, where the periodically updated information is transmitted from the first security system to the receiver, according to an update interval of the first security system. A control is provided for recovering the periodically updated information from the receiver. A transmitter is associated with the control for transmitting the periodically updated information to a second security system that secures a second building location different than the first building location. The second security system provides information regarding the first security system to a user via a user interface device in the second security system, according to the periodically updated information.

In yet another aspect of the invention, a security apparatus includes a user interface device in a first security system, where the first security system secures a first building location, and the user interface device receives a request by a user to establish two-way voice communication between the first security system and a second security system that secures a second building location different than the first building location. A control is associated with the user interface device for handling the request by the user. A transmitter is associated with the control that is responsive to the request by the user for transmitting a signal to a remote facility to cause the remote facility to communicate with the second security system to establish the two-way voice communication between the first security system and the second security system, via the remote facility.

In yet a further aspect of the invention, a method for providing security system related data to a personal computer includes running a web browser on the personal computer to connect to a designated web site to request information regarding at least a first security system that secures at least a first building location. A remote facility receives periodically updated information from the at least a first security system according to an update interval of the at least a first security system, and the web site has access to the periodically updated information. The method further includes displaying the information regarding the at least a first security system to the user, via the web browser, responsive to the request and the periodically updated information.

BRIEF DESCRIPTION OF THE DRAWINGS

These and other features, benefits and advantages of the present invention will become apparent by reference to the following text and figures, with like reference numbers referring to like structures across the views, wherein.

DETAILED DESCRIPTION OF THE INVENTION

Figure 1:
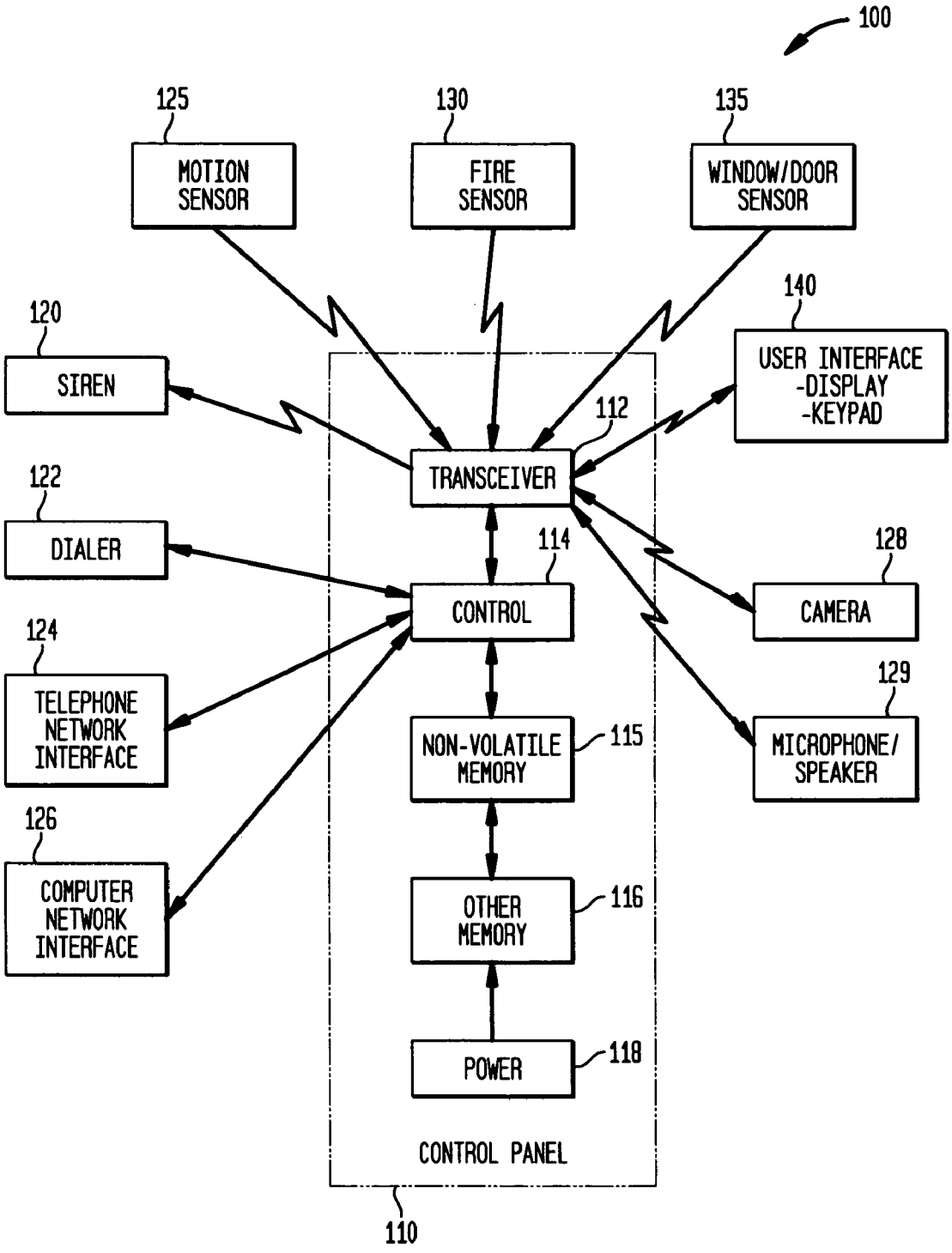
FIG. 1 illustrates an overview of an example security system, according to the invention.

FIG. 1 illustrates an overview of an example security system, according to the invention. The security system 100 includes a central control panel 110 that communicates with a number of sensors via a wired or wireless path. The wireless path may be an RF path, for instance. For example, the control panel 110 may receive signals from motion sensors 125 that detect when a person enters a room. Signals received from fire sensors 130 indicate that a fire has been detected. Signals received from window and door sensors 135 indicate that a window or door has been opened.

Signals received from a peripheral user interface device 140, such as a keypad and display, a combined display and touch screen, and/or a voice interface, may arm and disarm the system. The user interface device 140 may be the primary interface between the human user and the security system 100. The user interface device 140 may include components that are analogous to the control panel 110, including a control, memory and power source. Optionally, the user interface device 140 includes a transceiver (transmitter and receiver). The user interface device 140 is commonly provided in the home such as by affixing it to a wall or placing it on a table, for instance, while the control panel 110 generally is a larger component that may be installed, e.g., in a closet or basement. Optionally, the user interface device 140 is integrated into the control panel 110.

Various other components may communicate with the control panel 110, such as a wireless key fob/panic button that is used to trip an alarm. The control panel 110 may also transmit signals to components of the security system 100. For example, signals may be transmitted to a siren 120 to activate the siren when an alarm condition is detected. Signals may be sent to the user interface device 140 to display status information to the user, such as whether the system is armed or disarmed, whether a specific door or window has been opened, and, when the system is armed, whether an alarm has been tripped. The control panel 110 may also have the ability to notify local emergency services and/or a remote monitoring station of an alarm condition via a telephone dialer 122. Furthermore, a telephone network interface 124, such as a modem, allows the control panel 110 to send and receive information via a telephone link. The functionality of the dialer 122 may be combined into the interface 124. A computer network interface 126 allows the control panel 110 to send and receive information via a computer network, such as the Internet. The computer network interface 126 may include an always-on interface, such as a DSL or cable modem, and a network interface card, for example. Or, a dial-up telephone connection may be used. Other communication paths such as long-range radio and a cellular telephone link may also be used. The dialer 122 and interfaces 124 and 126 are typically hardwired to the control panel 110 and activated by the control 114.

One or more cameras 128 may be used to provide image data, including still or motion images, to the control 114 directly or via the transceiver 112. The image data is encoded and compressed for storage and/or transmission in a digital format. An appropriate storage medium such as a hard disk can be used to store the image data. The cameras can be positioned at various locations around the home or other secured location, including the exterior and interior. When an alarm occurs, image data from the camera that has a view of the area monitored by the sensor that tripped the alarm can be stored and communicated to a monitoring station and/or to a remote security system as discussed herein for remote viewing. Similarly, one or more microphones and speakers 129 can provide audio data from different locations around the secured premises to the control 114 directly or via the transceiver 112, and reproduce audio data received by the security system 100, e.g., to provide an intercom capability with one or more other security systems, as discussed further below. When an alarm occurs, audio data from the microphones that cover an area monitored by the sensor that tripped the alarm can be stored and communicated to a monitoring station and/or to a remote security system as discussed herein for remote listening. If an alarm is triggered, e.g., by a panic button on a key fob rather than by a sensor in a specific zone of the secured building, all video and/or image data can be communicated to the remote location.

It is also possible for a security system to send commands to another security system, via a remote facility, to control its cameras and microphones. For example, a camera may be mounted so that it can change its field of view, such as by zooming in or pivoting, via a motor control. In this case, such movements can be controlled remotely using an appropriate control and communication scheme. It is also possible to change the operating mode of a camera, such as by changing the rate or resolution at which it provides still frames, or switching from a still frame mode to a motion picture mode, or switching from a visible light mode to an infrared light mode, and so forth.

The control panel 110 includes a transceiver 112 for transmitting and receiving wireless signals. The control 114 includes a microprocessor that may execute software, firmware, micro-code or the like to implement logic to control the security system 100. The control panel 110 may include a non-volatile memory 115 and other additional memory 116 as required. A memory resource used for storing software or other instructions that are executed by the control 114 to achieve the functionality described herein may be considered a program storage device. A dedicated chip such as an ASIC may also be used. A power source 118 provides power to the control panel 110 and typically includes a battery backup to AC power.

According to the invention, an existing security system can be modified to communicate with a remote facility to allow different security systems to share information such as status information, audio and video data, and the like, and to allow a user at a security system to provide commands to the other security systems. Additionally, a user may communicate with the remote facility, such as via a web browser running on a personal computer, to access the information from one or more security systems. In one approach, existing communication components and transmitting and receiving protocols of the control panel 110 and/or user interface device 140 can be used. The appropriate control logic can be implemented as the control panel 110 and/or user interface device 140 are upgraded. Communication interfaces, such as interfaces 124 and 126, can be added as needed if they are not already present.

The functionality provided by the invention has many advantages. For example, the user has the ability to monitor and control a remote alarm system. The user can also monitor video and audio data of a remote location. In one possible approach, a user interface of a local security system, which may be at the user's home, for instance, is used to monitor and control a second security system located at another location, such as a relative's home. Some information may be made available to the user regarding the second location via a push approach, where the information is automatically provided to the user by a remote facility 250 (FIG. 2) without a request by the user. This may include relatively urgent information, such as alarm status information that indicates, e.g., whether an alarm has been set, when the alarm was set, the alarm type (e.g., intrusion alarm, fire alarm, noxious gas alarm), and other information such as an alert that the remote security system has a malfunction or requires immediate maintenance. Further detailed information regarding an alarm may also be provided to the local security system. For instance, for an intrusion alarm, the local security system may be provided information regarding the source of the alarm, such as which zone in a building has triggered the alarm, the type of sensor that has been tripped (window, door, motion, etc.), or whether a panic button has triggered the alarm.

Other information, such as routine status information, may be provided to the local security system by the remote facility 250 only when requested by the local security system. Such routine information may include whether the remote system is armed, details regarding the arming, such as whether certain zones have been bypassed, and whether the remote system requires routine maintenance. Information such as audio and video data from the remote system may also be provided on an as-requested basis.

Moreover, the invention enables the user to send commands to the remote security system, via the remote facility, to control the remote security system, e.g., to arm or disarm the system, set a bypass mode, and so forth. The bypass mode may be used to disable a sensor or zone in the secured building location that is triggering false alarms, for instance.

Advantageously, by communicating information via the existing security system components and infrastructure, there is no, or minimal, need for additional equipment in the secured location. Disruption to the home due to installing additional components and wires, for example, is minimal or nonexistent. Furthermore, features of the existing security system, such a backup power and central station monitoring, are maintained and leveraged.

Figure 2:
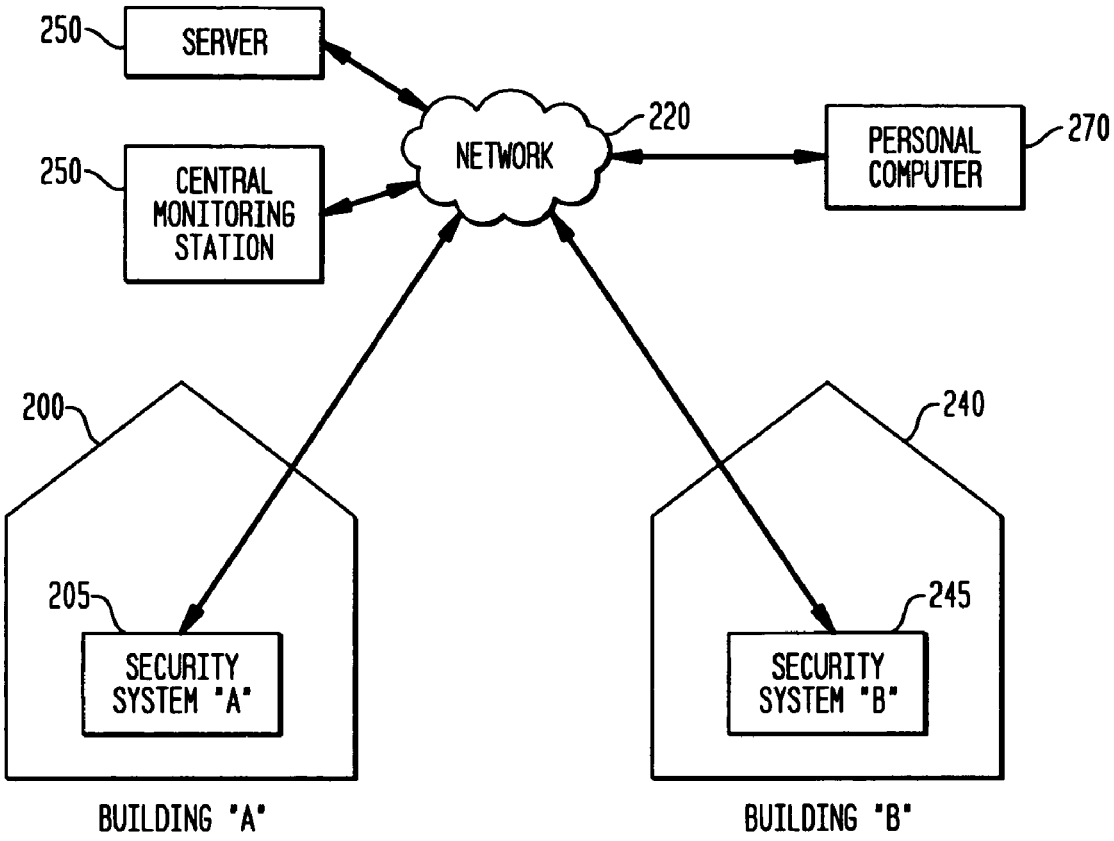
FIG. 2 illustrates an arrangement with two security systems, a personal computer, and a remote facility, according to the invention.

FIG. 2 illustrates an arrangement with two security systems, a personal computer, and a remote facility, according to the invention. A first building location (building "A") 200 is secured by a first security system (security system "A") 205, while a second building location (building "B") 240 is secured by a second security system (security system "B") 245. The building locations may be separate structures, such as individual homes or business facilities. Or, the building locations may be different parts of a common structure, such as different apartments in an apartment building, or the lower and upper levels of a house, for instance. Note that the concept can be extended to more than two security systems and building locations. Moreover, communication between security systems needed not be bi-directional. Thus, the invention encompasses a scenario where the first security system 205 can access information regarding the second security system 245, but the second security system 245 does not have the ability to access information regarding the first security system. With bi-directional communication, each security system has similar transmit and receive capabilities.

The security systems 205 and 245 each communicate with a remote facility 250, such as a server, via one or more networks, such as example network 220. In one approach, the server 250 aggregates data from the different security systems 205, 245, and communicates with the different security systems. The server 250 may also report urgent information such as alarms to a central monitoring station 260. The central monitoring station 260 is typically a staffed facility where operators monitor incoming communications to determine when an alarm is set by a monitored security system. The operator may attempt to determine if an alarm was set inadvertently by telephoning the secured location. If the alarm was not set inadvertently, the operator contacts emergency services such as fire or police personnel in the appropriate municipality by telephone to report the alarm. In one possible approach, all communications with the security systems 205, 245, are handled by the server 250, and the server 250 forwards certain communications such as alarms to the central monitoring station 260. In another possible approach, routine communications with the security systems 205, 245, are handled by the server 250, while alarm message are sent directly to the central monitoring station 260. In another possible approach, all communications with the security systems 205, 245 are handled by the central monitoring station 260, which subsumes the functions of the server 250. In any case, the security systems 205, 245 communicate with one or more remote facilities which include computers for storing and processing data, and network interfaces such as receivers and transmitters for receiving and transmitting data, respectively.

Thus, in one approach, the remote facility 250 provides data sharing between the security systems 205, 245. The network 220 can include essentially any type of communication path or paths, including a telephone link, such as a conventional telephone network, to communicate with the remote facility 250. In this case, signaling using a compatible modem may be used. In another approach, the network 220 includes a computer network 220 such as the Internet. For instance, the security systems 205 and 245 may use a communications protocol such as TCP/IP to communicate with the remote facility 250. Other communication paths such as satellite or RF radio paths, including, e.g., those using GSM or CDMA techniques, may also be used. Moreover, the different security systems may use different communication paths, and upstream communications to the remote facility 250 may be on different paths than downstream communication from the remote facility 250. Multiple paths of the same or different type may also be used for redundancy. The different communication paths may be attempted serially until a successful communication is made.

According to the invention, the security systems 205, 245 may periodically transmit data to the remote facility 250 at regular update intervals, e.g., every ten seconds. This data can include essentially any information that is maintained by the security system. For example, the information can include an armed status indicating, e.g., whether the security system is armed and whether zones are bypassed, a trouble code, a maintenance status, or the like. The information can also indicate whether a door or window is open, and whether a motion sensor has been tripped. Video and audio data can also be provided to the remote facility 250. Moreover, the security system may interact with, or be part of, a home automation network, in which case information regarding the home automation network can be provided. This may include, for instance, heating or air conditioning system settings. Information from a medical device such as a heart rate monitor can also be provided to the remote facility 250, e.g., to allow a user to check in on the medical condition of a relative.

In response to a received message, the remote facility 250 processes the message and performs an action according to control logic implemented therein. For example, if the remote facility 250 receives data from security system "A" 205 indicating that an alarm has been tripped, the remote facility can notify security system "B" 245 of this fact by transmitting a signal to it to cause it to provide an appropriate message to a user. The messages from the respective security systems may include identifiers that identify the security systems. Generally, the remote facility 250 can maintain data regarding the identity of one or more security systems that are to be notified when a specified occurrence is detected at one or more other security systems. This data can be configured beforehand by the operator of the remote facility 250 by obtaining appropriate permissions of the users of the different security systems.

Furthermore, the remote facility 250 can send commands to one or more security systems based on commands received from one or more other security systems. For example, in the above example, where security system "B" 245 is notified that an alarm has been tripped at security system "A" 205, the user at security system "B" 245 may telephone a person at the location of security system "A" 205, or a nearby location, such as a neighbor's home, to determine if the alarm was a false alarm. If it was a false alarm, the user at security system "B" 245 can enter a command to turn off the alarm at security system "A" 205. The command is transmitted to the remote facility 250, which, in response, transmits a signal to security system "A" 205 to cause it to turn off the alarm.

Generally, as mentioned, the remote facility 250 may determine whether information it has received from one security system is urgent enough that it should be provided to another security system automatically, with being requested, or is routine and therefore can be provided on an as-requested basis.

As an example of providing information on request, assume the user at security system "A" 205 enters a command via a user interface to obtain status information regarding security system "B" 245. In response to the command, security system "A" 205 transmits the command to the remote facility 250, e.g., via transmitters at the telephone network interface 124 or computer network interface 126, for example. The remote facility 250 receives and processes the command and performs an action according to control logic implemented therein. In this case, the remote facility 250 accesses its memory to determine the most recent status information that has been received from security system "B" 245 and transmits a message back to security system "A" 205 to inform it of this status. Security system "A" 205 receives the message, e.g., via receivers at the telephone network interface 124 or computer network interface 126, for example. Note that it is not necessary for the remote facility 250 to query security system "B" 245 since security system "B" automatically updates the remote facility 250 according to a predetermined update interval. However, this option is also possible. For example, the security system can provide the audio and/or video data in response to a request from a user via the remote facility 250. Moreover, the audio and/or video data can be provided on the initiative of the security system when certain events occur, such as an alarm event. Or, the audio and/or video data can be provided with the periodic updates if there is sufficient bandwidth. The transmission of compressed still video frames should be achievable.

Note that the remote facility 250 may also have the capability to download software to a security system to change its behavior, including changing the update interval and other pre-programmed behaviors, such as the types of data transmitted during the periodic updates.

Having the security systems 205, 245 automatically provide their status information to the remote facility 250 at predetermined intervals is advantageous since it provides a higher level of security. For example, each security system may communicate with the network 220 via a firewall, in which case it is more secure to transmit through the firewall, from the security system to the network, and not from the network to the security system. Moreover, the remote facility 250 is continuously informed of the status of the different security systems and can therefore respond to status requests from the security system more quickly than if the remote facility 250 had to query the security systems for each status request.

Additionally, a personal computer 270 running appropriate software such as a web browser may be used to display information to a user regarding the one or more security systems 205, 245. For example, the user may enter a command via the web browser to cause the personal computer to connect to a designated web site to request information regarding a specific security system. The server 250 may provide the web site, for example. In response to the request, the web site accesses the periodically updated information and provides it to the personal computer 270 to enable the web browser to provide an appropriate display. In another approach, the web site is hosted by another server that communicates with the server 250 to access the periodically updated information at the server 250.

Figure 3:
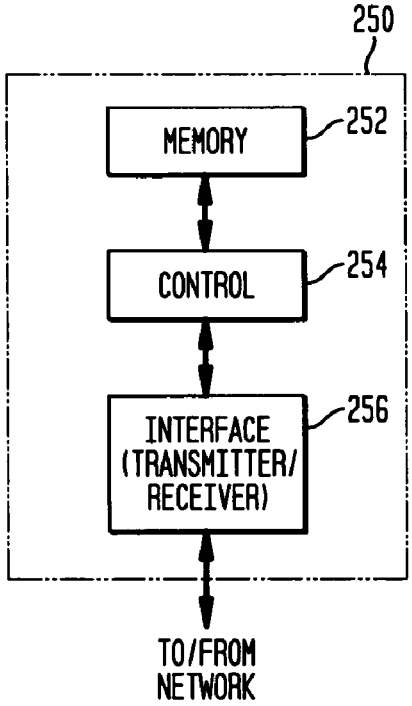
FIG. 3 illustrates a remote facility, according to the invention.

FIG. 3 illustrates a remote facility according to the invention. The remote facility 250 can include a general purpose computer that is programmed to achieve the functionality described herein. The remote facility 250 is typically provided at a staffed facility that is remote from the security systems which it serves. The staff at the remote facility 250 may monitor the alarm status of the different security systems and take appropriate actions such as notifying emergency personnel when an alarm is tripped. Multiple remote facilities may be provided as needed to serve multiple security systems.

The remote facility 250 includes an interface 256, including a receiver and transmitter, for communicating with different security systems via one or more networks. A control 254 is used to execute software instructions stored in the memory 252 to achieve the desired functionality, including recovering the periodically updated information and other data from the security systems, and initiating transmissions to the security systems. A memory resource used for storing software or other instructions that are executed by the control 254 to achieve the functionality described herein may be considered a program storage device. The memory 252 may also store data, e.g., for identifying which security systems are to be notified when an alarm or other specified event occurs at a given security system. Information for contacting each of the security systems may also be stored. For example, when the remote facility 250 and a security system communicate via a computer network, the remote facility may store an IP address of the security system. In this case, the interface 256 may be a network interface card. When the remote facility 250 and a security system communicate via a telephone network, the remote facility may store a phone number of the security system as well as modem settings. In this case, the interface 256 may be a modem. In practice, the remote facility 250 may have a number of computers with different interfaces to enable communication with a large number of security systems at the same time via different communication paths. Encryption and authentication protocols may be implemented as well.

Figure 4:
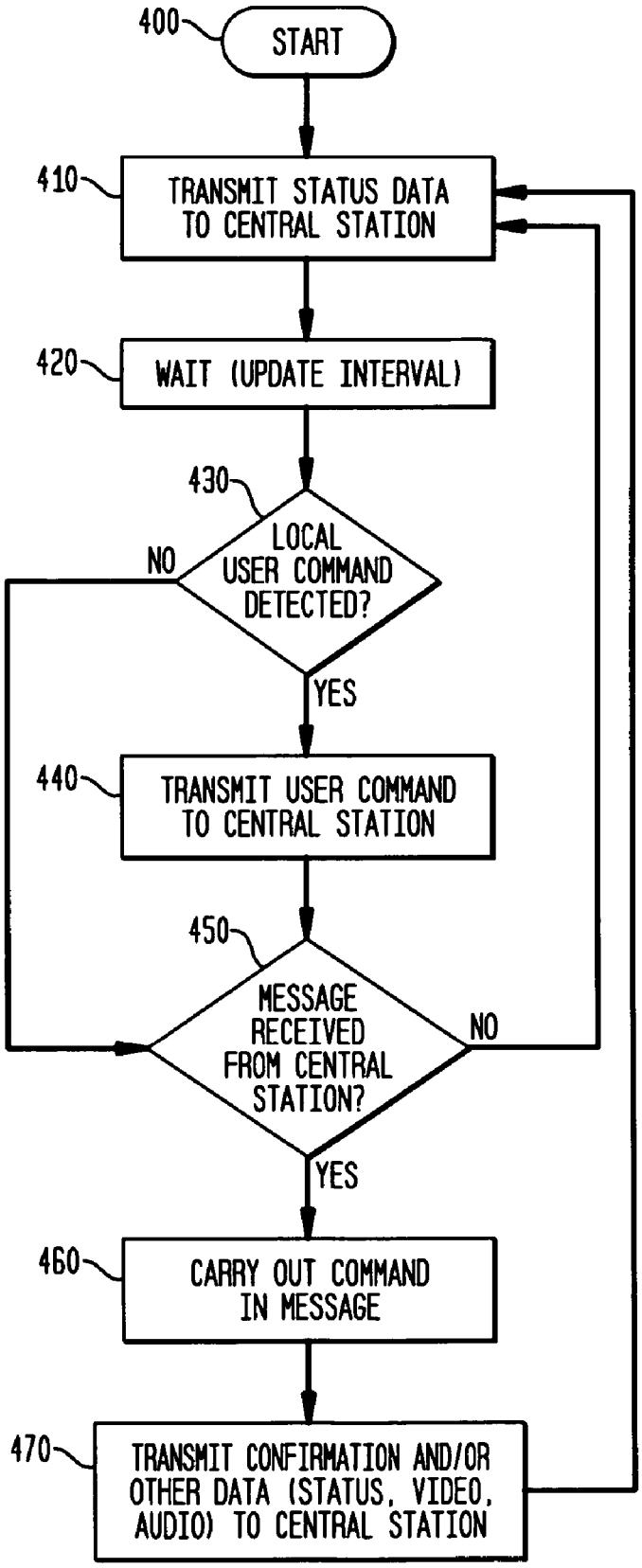
FIG. 4 illustrates a method used by a security system, according to the invention.

FIG. 4 illustrates a method used by a security system according to the invention. The process begins at block 400. At block 410, the security system transmits status data to the remote facility. It is also possible for the security system to transmit any other data that it has, such as video or audio data. At block 420, a wait period or update interval is implemented. For example, a ten second wait may be used. It is desirable to have a relatively short update interval so that the remote facility can receive important information from a security system quickly. At block 430, if a local user command is detected, the security system transmits the user command to the remote facility. For example, the command may be to obtain status or other information from another security system, or to control another security system, such as by arming or disarming it. This transmission can occur immediately, separately from the periodic status data transmission, to avoid unnecessary delays. However, it is also possible to wait until the next status data update to transmit the command. It is also possible to send the latest status data with the command. If, at block 430, no local user command is detected, processing proceeds at block 450. At block 450, if a message has been received from the remote facility, the security system carries out the command in the message. For example, the message may include a command to implement an intercom feature or to provide audio and/or video data. If no message has been received at block 450, processing proceeds at block 410. At block 470, the security system may transmit a confirmation that the message was received from the remote facility. Other data, such as requested status, video and audio data may be transmitted as well.

Figure 5:
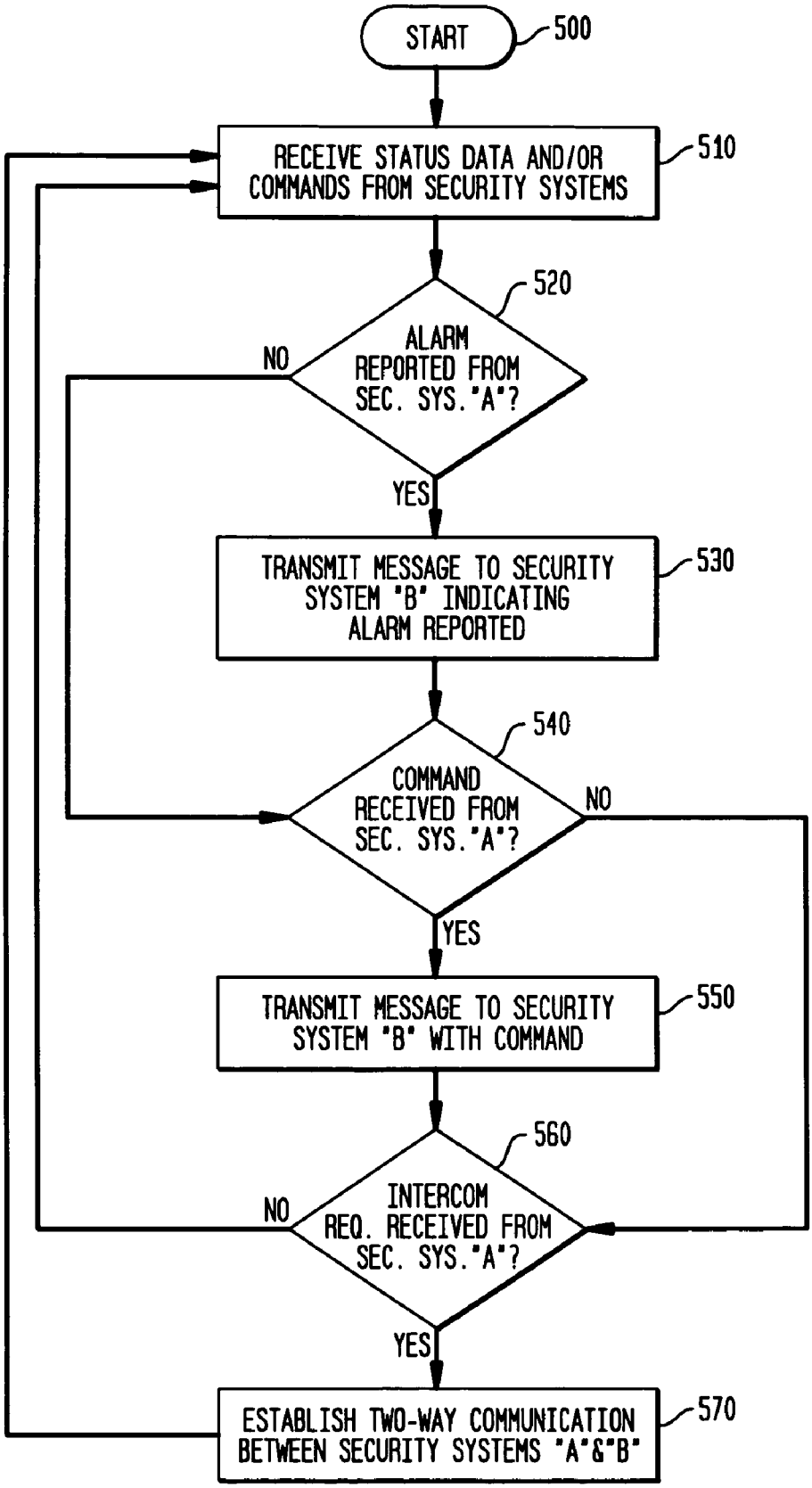
FIG. 5 illustrates a method used by a remote facility, according to the invention.

FIG. 5 illustrates a method used by a remote facility according to the invention. The process begins at block 500. At block 510, the remote facility receives status data and/or commands from different security systems. At block 520, if an alarm has been reported, for example, at a security system "A", the remote facility transmits a message to one or more other specified security systems, such as a security system "B" (block 530). Note that an alarm can be reported to the remote facility with the status data during the periodic transmissions or reported immediately as a separate transmission. If no alarm is reported at block 520, processing proceeds at block 540. At block 540, if a command has been received from a security system, for example, from security system "A", the remote facility transmits a message with the command to one or more other specified security systems, such as security system "B" (block 550). If no command is received at block 540, processing proceeds at block 560.

At block 560, if an intercom request is received from a security system, for example, from security system "A", the remote facility establishes two-way communication between security systems "A" and "B" and, optionally, other security systems. For example, the Voice over Internet Protocol (VOIP) or may be used over a computer network. When the remote facility is connected to the security systems via the PSTN, the remote facility can activate a switch to connect the lines of the security systems. The intercom feature allows users at the different security systems to quickly communicate with one another by voice. One of the users can initiate the connection, e.g., by pressing an appropriate key on a user interface. The control at the security system handles the request and initiates contact with the remote facility via a transmitter. A microphone at the security system being contacted can be made live automatically or in response to a user answering the intercom request.

Figure 6:
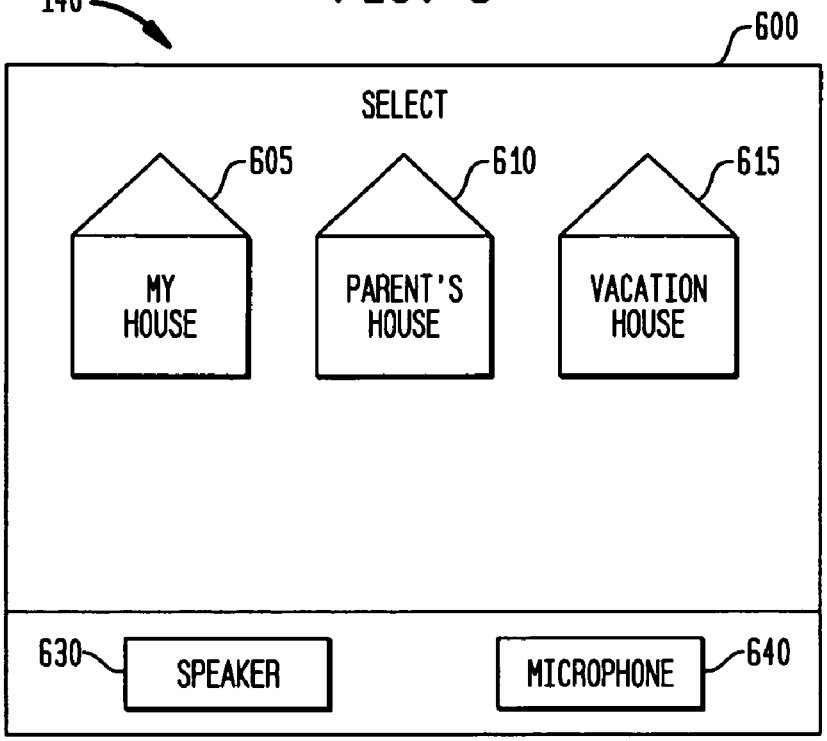
FIG. 6 illustrates an example user interface that allows a user to select a location, according to the invention.

FIG. 6 illustrates an example user interface that allows a user to select a location, according to the invention. In one possible approach, the user interface device 140 includes a graphical user interface such as a touch screen display 600 for displaying information and receiving user commands or entries. Alternatively, a push button keypad may be used. A a speaker 630 and microphone 640 may be provided for speech recognition in a voice-activated system, or for use in an intercom. The speaker 630 may also play audio data from another security system. In the example shown, the display area 600 includes user-friendly identifiers such as icons that identify the local security system and one or more other security systems that can be accessed. In particular icons 605, 610, and 615 represent the security systems associated with the user's house (in which the interface 140 is located), the parent's house, and the vacation house, respectively. The display 600 prompts the user to select a location by touching one of the icons. Assuming the user desires to view information regarding the security system at the parent's house, the user touches the icon 610, which causes the display 700 of FIG. 7 to appear.

When security data is accessed by the web browser running on the personal computer 270, the browser may provide a graphical user interface and display similar to that discussed and shown for the user interface device 140 to display information to the user and receive commands from the user. Commands may be received via an appropriate input device such as a mouse, for instance.

Figure 7:
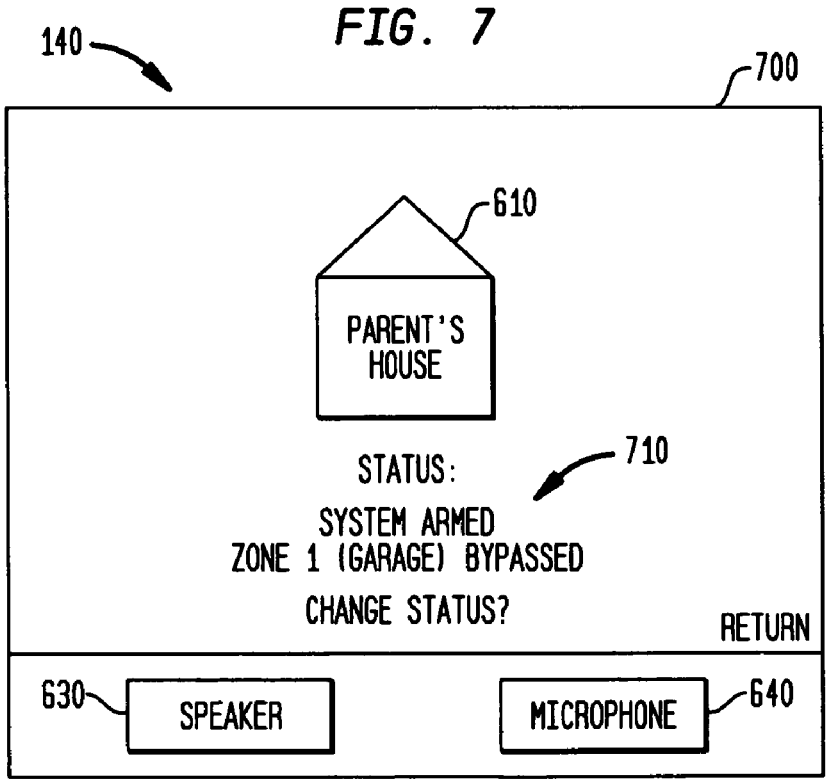
FIG. 7 illustrates an example user interface displaying information regarding a selected location, according to the invention.

FIG. 7 illustrates an example user interface displaying information regarding a selected location, according to the invention. As discussed, in response to the user's selection, e.g., command, the security system associated with the user interface device 140 transmits a request to the remote facility to obtain the information regarding the security system at the parent's house. The remote facility replies by transmitting the periodically updated information that it has maintained to the local security system for use in generating the display 700. The display 700 includes a region 710 that indicates that the security system at the parent's house is armed, and that zone 1, which covers the garage, is bypassed. After viewing the desired information, the user can control the user interface 140 to view information regarding another remote security system, or regarding the local security system. For example, the user may touch "return" on the display 700 to return to the display 600 of FIG. 6, then select one of the other house icons to view the corresponding status information.

Or, from the display 700, the user can enter a command to change the status of the remote security system, such as by changing the armed status, which zones are bypassed, and so forth. To do this, the user touches the area of the screen 700 which displays "change status?", which causes the display 800 of FIG. 8 to appear.

Figure 8:
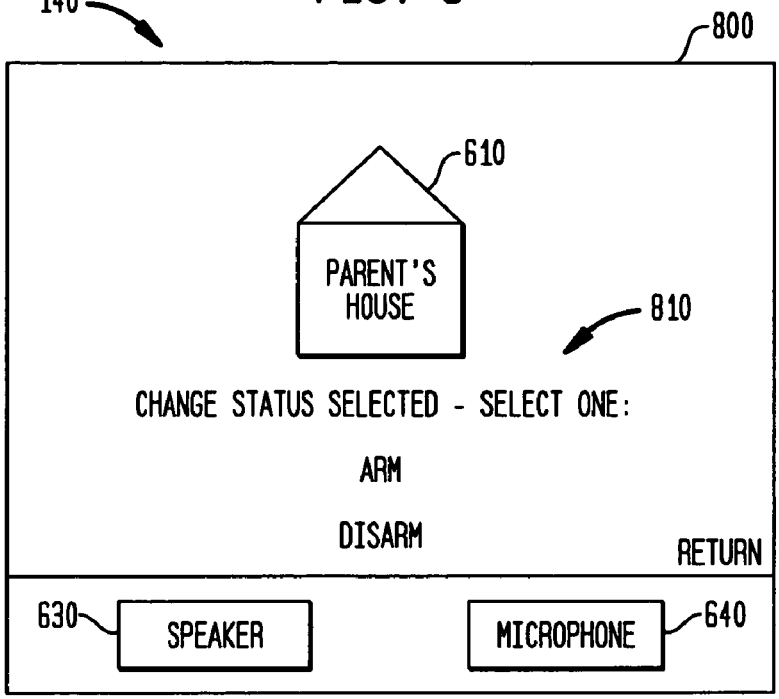
FIG. 8 illustrates an example user interface that allows a user to change a status, according to the invention.

FIG. 8 illustrates an example user interface that allows a user to change a status, according to the invention. The display 800 includes a region 810 that allows the user to change the status of the security system at the parent's house, such as by arming or disarming the system. To do this, the user touches the display 800 near the words "arm" or "disarm". Assuming, the user wishes to disarm the system, the user touches "disarm", which causes the display 900 of FIG. 9 to appear.

Figure 9:
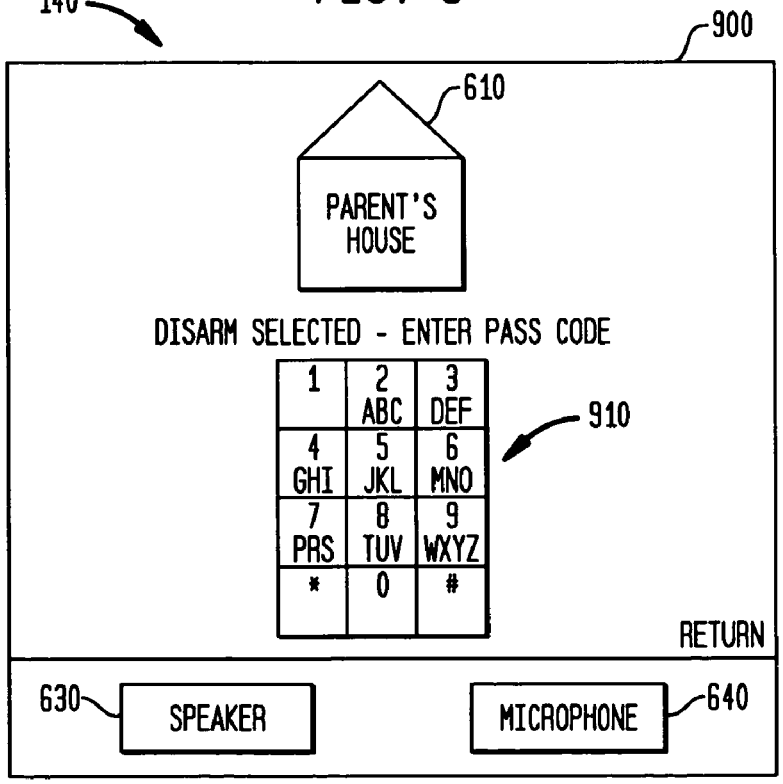
FIG. 9 illustrates an example user interface that allows a user to enter a pass code, according to the invention.

FIG. 9 illustrates an example user interface that allows a user to enter a pass code, according to the invention. The display 900 includes a region 910 that allows the user to enter a pass code for disarming the security system at the parent's house. Specifically, the region 910 provides a keypad which the user activates by touching a sequence of numbers and/or letters, then touching the "#" key, for example, when finished. If the pass code is correct, the user interface 140 initiates a communication from the local security system to the remote facility, which in turn initiates a communication to the security system at the parent's house to disarm the system.

Generally, control logic associated with the user interface device 140 allows it to control both the local security system and one or more remote security systems. In particular, the user interface device 140 may include a microprocessor that executes software, firmware, micro-code or the like stored in memory, or a dedicated chip such as an ASIC, to control the local and remote security systems. However, the intelligence can be carried out at different locations in the security system 100, such as at the control panel 110. By providing a uniform appearance and functionality among the user interface devices at the different locations that are secured by the different security systems, the user can easily learn and use the new features described herein.

The user interface device 140 may be configured by the user or installer with the contact information of the remote facility with which it will communicate. The configuration information may include, e.g., an IP address, telephone number, or serial number, password or other identifier of the remote facility. Menu prompts may be displayed on the user interface device 140 to allow the user or installer to identify and configure the information. The user interface device 140 may also be configured with access information for changing the status of the other security systems, such as the pass codes for arming and disarming the other systems. The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A remote facility which is remote from a first security system that secures a first building location, and a second security system that secures a second building location different than the first building location, comprising:

a receiver operable to receive periodically first updated information from a first security system that secures a first building location and second updated information from a second security system that secures a second building location different than the first building location, the receiver further operable to receive one or more commands from the first security system for controlling the second security system and one or more commands from the second security system for controlling the first security system;

a control for recovering the first and second updated information from the receiver; and a transmitter associated with the control operable to transmit the first updated information to the second security system, the second security system operable to provide information regarding the first security system to a second user via a second user interface device in the second security system according to the first updated information, the transmitter further operable to transmit the second updated information to the first security system, the first security system operable to provide information regarding the second security system to a first user via a first user interface device in the first security system according to the second updated information.

* * * * *